United States Patent [19]

Justice et al.

[11] Patent Number: 4,556,257

[45] Date of Patent: Dec. 3, 1985

[54] HORIZONTAL EDNA MINER

[75] Inventors: James C. Justice; Frank A. Delli-Gatti, Jr., both of Beckley, W. Va.

[73] Assignee: Coaltex, Inc., Beckley, W. Va.

[21] Appl. No.: 512,712

[22] Filed: Jul. 11, 1983

[51] Int. Cl.[4] ..... E21C 27/24

[52] U.S. Cl. ..... 299/68; 299/1; 299/78; 299/18

[58] Field of Search ..... 299/1, 18, 31, 76, 78, 299/68, 80

[56] References Cited

U.S. PATENT DOCUMENTS

| | | | |
|---|---|---|---|
| 3,044,753 | 7/1962 | Wilcox, Jr. | 299/68 |
| 3,712,679 | 1/1973 | Amoroso | 299/80 |
| 3,730,593 | 5/1973 | Karlorsky | 299/80 |
| 3,966,258 | 6/1976 | Dolecki | 299/76 |
| 4,003,602 | 1/1977 | Justice et al. | 299/18 |
| 4,082,362 | 4/1978 | Justice et al. | 299/57 |
| 4,120,535 | 10/1978 | Delli-Gatti, Jr. | 299/18 |
| 4,143,552 | 3/1979 | Godfrey | 299/1 |
| 4,274,675 | 6/1981 | Paurat et al. | 299/31 |
| 4,441,761 | 4/1984 | Fields et al. | 299/76 |

*Primary Examiner*—Stephen J. Novosad
*Assistant Examiner*—M. Goodwin
*Attorney, Agent, or Firm*—Cushman, Darby & Cushman

[57] ABSTRACT

A mining machine is utilized for making original generally horizontal bores in coal steams, and for enlarging preexisting bores. A single cutting head is mounted for rotation about a first horizontal axis generally perpendicular to the dimension of elongation of the horizontal bore, and is pivotal about a second horizontal axis, parallel to the first axis, to change its cutting, vertical position within the bore. A non-rotatable body member, with side wall supports, is mounted posteriorly of the cutting head, and includes a conveyor mechanism and a power mechanism operatively connected to it. The machine can be sumped into a bore and then the cutting head rotated about the second axis to change the vertical position thereof, and then moved rearwardly, any cut material being continuously conveyed to the bore mouth by the conveyor mechanism. The amount of vertical movement during the pivoting action about the second axis is controlled in response to the automatic sensing of the thickness of the coal seam in which the machine operates.

6 Claims, 2 Drawing Figures

HORIZONTAL EDNA MINER

BACKGROUND AND SUMMARY OF THE INVENTION

The invention relates to a mining machine that is utilizable for the formation and/or enlarging of generally horizontal bores in coal seams, or the like. The invention has some of the same features, and functionality, as the machines in prior U.S. Pat. Nos. 4,082,362 and 4,120,535, the disclosures of which are hereby incorporated by reference herein. The device according to the present invention is particularly useful for mining coal seams having a relatively small, but varying, thickness.

The mining machine according to the present invention is for forming, and for use in, elongated generally horizontal bores in coal seams and the like. The machine includes a non-rotatable body member, with stabilizing means for insuring non-rotative movement of the body member in a bore. The body member preferably includes a pair of side wall supports extending in a first, generally horizontal, direction, parallel to the direction of elongation of the bore in the coal seam.

A single cutting head is mounted in front of the non-rotatable body member, and rotatable about a first axis. Power means are provided for rotating the cutting head about the first axis to effect cutting of coal or the like. Such power means may comprise a pair of shafts operatively connected to the non-rotatable body member, and rotatable with respect thereto, and interconnected to the cutting head through a cutting chain, and sprocket, arrangement. Both powered shafts are rotatable in the same direction, and effect coincident rotation of opposite sides of the cutting head.

Conveying means are mounted behind the cutting head in operative association with the body member for conveying material cut by the cutting head away from the cutting site in the dimension of elongation of the bore. The conveying means may comprise: a pair of auger flights operatively connected to the rotating shafts, and immediately posterior of the cutting head; scoop means disposed posteriorly of the auger flights and including a bottom portion substantially abutting the bore floor and extending posteriorly at a positive angle; and a conveyor belt disposed posteriorly of the scoop means and extending to the bore mouth, the scoop means funnelling toward the conveyor belt, and a top, transporting surface of the conveyor belt disposed adjacent the termination of the scoop means.

The machine also comprises means for pivoting the cutting head first axis about a generally horizontal second axis generally perpendicular to the bore dimension of elongation (and the dimension of elongation of the support side walls), so that the first axis is movable from a first cutting position of the cutting head substantially in-line with the conveying means, to other cutting positions vertically displaced from the first cutting position. A gamma ray sensor, or like sensing means, may be provided for automatically sensing the coal seam thickness. The sensor then controls the pivotal movement of the cutting head about the second axis to move either upwardly or downwardly to cut additional coal from the coal seam.

A conventional sumping means, such as shown in U.S. Pat. No. 4,120,535, is provided for moving the machine inwardly in the bore, and outwardly during periodic back-cutting thereof. The power means for powering all of the components, like the conveying means, extends to the bore mouth. Such an arrangement provides maximum safety, minimizes the complexity of construction of the in-bore components of the machine, and maximizes utility.

The invention also contemplates a method of mining coal from a generally horizontally extending coal seam. The cutting head is powered about the first axis, and the cutter is sumped inwardly into the coal seam a predetermined distance (e.g. 2 feet) to thereby cut coal from the coal seam to form a bore having a height approximately equal to the diameter of the cutting head (e.g. 26 inches). Then the cutting head is pivoted about a second horizontal axis, parallel to the first axis, so that the cutting head moves vertically in the bore and continues to cut coal from the coal seam while moving vertically. Then the cutting head is moved rearwardly toward the bore mouth while in its second position, to continue cutting from the coal seam to thereby enlarge the bore so that it has a height substantially equal to the diameter of the cutting head plus the vertical distance it has been moved. Cut coal is continuously conveyed to the bore mouth during all of the cutting steps, and the cutting steps are successively practiced while powering of the cutting head, and conveyance of the coal from the cutting site, are continued.

It is the primary object of the present invention to provide a mining machine, and method of mining, for the effective mining of coal or the like from generally horizontally extending seams. This and other objects of the invention will become clear from an inspection of the detailed description of the invention, and from the appended claims.

BRIEF DESCRIPTION OF THE DRAWINGS

FIG. 2 is a side view of the machine of FIG. 1 showing the cutting head in a first position in solid line, and showing the cutting head in other positions in dotted line.

DETAILED DESCRIPTION OF THE DRAWINGS

Figure 1:
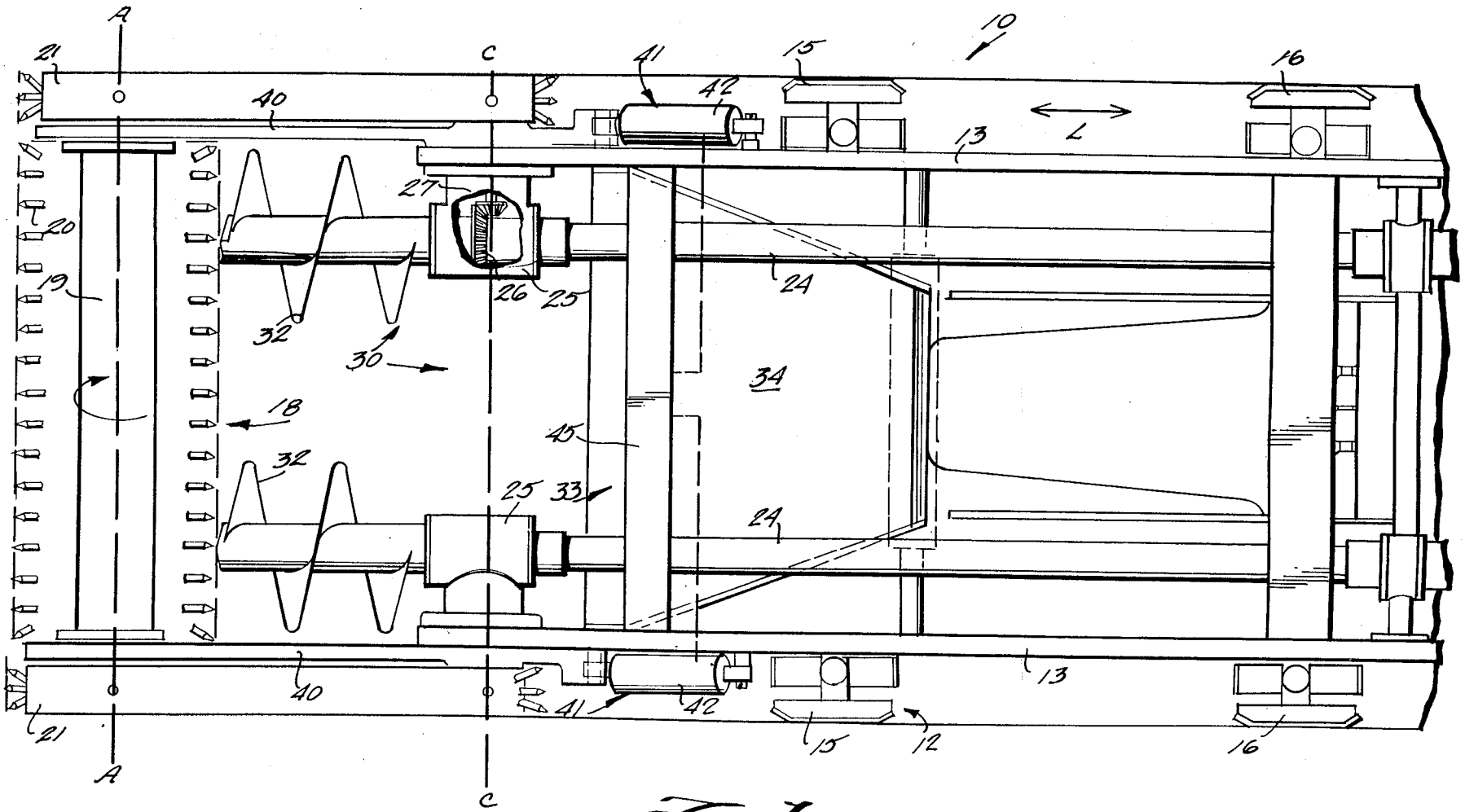
FIG. 1 is a top plan view of an exemplary mining machine according to the present invention.
Figure 8:
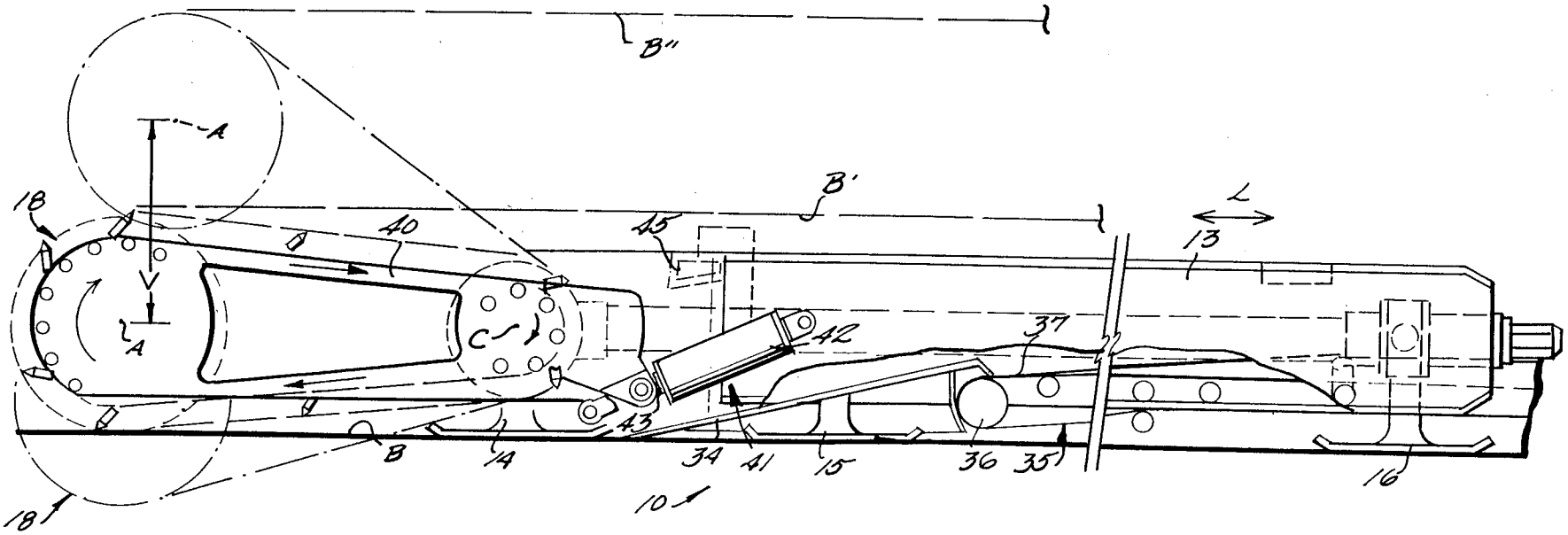

An exemplary mining machine according to the present invention is shown generally by reference numeral 10 in the drawings. The machine is particularly adapted for use in elongated generally horizontally extending bores in coal seams or the like. In FIG. 2 a typical bore floor is shown by reference character B, while typical bore ceilings are illustrated in dotted line and referenced by characters B′, B″.

The machine 10 includes a non-rotatable body member, shown generally by reference numeral 12, and including a pair of side wall supports 13 extending in the generally horizontal dimension of elongation L of the bore, with front, intermediate, and rear skids 14, 15, and 16, respectively, supporting the side wall supports 13 on the bore floor B.

Mounted anteriorly of the body 12 is the cutting head. Preferably a single cutting head, shown generally by reference numeral 18, is provided. The cutting head may comprise a single elongated drum 19 with conventional cutters 20 extending therefrom with powered cutting chains 21 on the sides thereof. That is the cutting head 18 is substantially identical to one of the cutting heads 14 shown in U.S. Pat. No. 4,082,362, the disclosure of which is hereby incorporated by reference herein. The cutting head 18 is rotatable about a first, generally horizontal axis A—A, the axis A—A being essentially perpendicular to the dimension of elongation L of the bore.

Power means are provided for rotating the cutting head 18 about the axis A—A to effect cutting of coal or the like. The power means includes the cutting chains 21 and appropriate sprocket arrangements disposed at the ends of the chain 21 loops, as in said U.S. Pat. No. 4,082,362. Power is ultimately provided for the rear sprockets of the cutting chains 21 by a pair of powered shafts 24. A gear housing 25 mounts each of the shafts to a side wall support 13 for rotation with respect to the body member 12, and bevel gear means 26 (shown schematically in FIG. 1) or the like are provided for transforming rotation of a shaft 24 into powered movement of a shaft 27 to which a rear sprocket for the cutting chain 21 is mounted.

Conveying means, shown generally by reference numeral 30, are provided mounted posteriorly of the cutting head 18 in operative association with the body member 12 for conveying material cut by the cutting head 10 away from the cutting site in the dimension L, to the bore mouth. The preferred conveying means 30, as illustrated in the drawing, has many features in common with the conveying means shown in U.S. Pat. No. 4,120,535, the disclosure of which is hereby incorporated by reference herein. Alternatively, the conveying means may include a vacuum arrangement such as shown in co-pending U.S. patent application No. 478,479 filed Mar. 24, 1983.

The conveying means 30 illustrated in the drawings include an auger flight section 32 connected to each of the shafts 24 and immediately posteriorly of the head 18. The auger flight sections 32 feed cut coal toward the scoop means 33, which includes a bottom portion 34 substantially abutting the bore floor B and then extending posteriorly therefrom at a positive angle. The conveying means 30 also comprises a conveyor belt 35, in cooperative engagement with the front conveyor roller 36, and including a top, conveying, surface 37 thereof. The transporting surface 37 of the conveyor belt 35 is disposed adjacent the termination of the scoop bottom portion 34, as seen most clearly in FIG. 2, and the conveyor belt 35 leads to the bore mouth. The conveyor belt 35 is operatively associated with a belt take-up unit, the conveyor belt comprising an endless belt, and the take-up unit comprising a series of varying diameter rollers about which the belt is laced so that the length of the belt outside the take-up unit may be automatically adjusted. The take-up unit, and cooperating conveyor mechanism, are shown more fully in said U.S. Pat. No. 4,120,535.

The machine 10 also comprises means for pivoting the axis A—A about a generally horizontal second axis C—C. The axis C—C is parallel to the axis A—A, and thus is also generally perpendicular to the dimension L. The axis A—A is movable from a first position, as illustrated in solid line in FIG. 2, to a plurality of other cutting positions, as illustrated in dotted line in FIG. 2. In the first position—illustrated in solid line in FIG. 2—the cutting head 18 is substantially in-line with the conveying means 30. In the other positions, the cutting head 18 is vertically displaced from the first position. For instance when in the upwardmost vertical position, the axis A—A is displaced upwardly a vertical distance V from that in its first position, this maximum vertical displacement V being, preferably, slightly less than the diameter (e.g. 26 inches) of the cutting head 18.

The means for pivoting the cutting head 18 about the axis C—C is generally comparable to the means for pivoting the vertical-axis cutting heads 14 about vertical axes in said U.S. Pat. No. 4,082,362. In particular, such means comprise a pair of support arms 40 operatively interconnecting the rear sprocket shafts 27 (including bearing means) and the drum 19 and front sprockets associated with the chain 21 (including bearing means), and thus operatively connected for pivotal movement about the axis C—C with respect to the side wall supports 13. Hydraulic cylinders 41, or like power means, are provided for effecting pivotal movement of the arms 40 about the axis C—C. The power means 41 preferably comprise a pair of piston-cylinder arrangements, with the cylinder portion 42 thereof connected to one of the arms and the side walls (e.g. a side wall 13), and the piston portion 43 thereof connected to the other of the arms and the side walls (e.g. an arm 40). Appropriate bearing means are also provided in the side walls 13 for receipt of the shafts 27, and pivot means for mounting the arms 40 for pivotal movement, about axis C—C.

The machine 10 also comprises means for sumping the body member 12 and the cutting head 18. The sumping means comprises an operating carriage, and the like, as disclosed in said U.S. Pat. No. 4,120,535. The shafts 24 are connected by a plurality of add-on sections (like sections 58 in said U.S. Pat. No. 4,120,535) so that said shafts 24 are operatively connected to a power source mounted at the bore mouth, exteriorly of the bore. This minimizes the complexity of the design of components within the bore, and maximizes safety.

The machine 10 also comprises means—shown schematically by reference numeral 45 in the drawings—for sensing the thickness of a coal seam or the like in which the bore is disposed. The means 45 may comprise a conventional S.E.I. type 803 natural gamma sensor, or a like device for automatically determining coal seam thickness. The device 45 is operatively interconnected—as shown by the schematic control lines in the drawings—to the power means 41 for effecting the desired pivotal movement of the arms 40 about the axis C—C in response to coal seam thickness. Also, the means 45 may control other directional means for effecting centering of the machine 10 in the coal seam, as described in said U.S. Pat. No. 4,120,535.

OPERATION

In a typical operation of the machine 10, the cutting head 18 is powered about the first axis A—A. The power is supplied through shafts 24 from the bore mouth, the shafts 24 rotating in the same direction and acting through bevel gear means 26 and rear sprocket shafts 27 to power the cutting chains 21, which in turn effect powering of the front sprockets attached to the cutting drum 19, and thus powering of the entire cutting head 18 in the direction of rotation indicated in the drawings.

From the bore mouth, the cutter 18 is sumped inwardly into the bore while the cutter is in the first position thereof (solid line position in FIG. 2), generally in-line with the conveying means 30. The cutter is sumped inwardly any predetermined distance (e.g. two feet), to thereby cut coal from the coal seam to form a bore having a height approximately equal to the diameter of the cutting head (e.g. 26 inches; see the distance between bore floor B and first ceiling B' in FIG. 2).

After cutting of the coal from the entire predetermined distance that the machine has been sumped, the hydraulic cylinder assemblies 41 are operated to pivot the cutting head 18 about the axis C—C. This pivotal action can be so that the cutting head 18 moved up and/or down, depending upon the particulars of the coal seam. The gamma ray sensor 45 automatically senses the coal seam thickness and controls the hydraulic cylinders 41 to effect pivotal movement so that the desired vertical movement of the cutting head 18 is effected. It is desired that the cutting head 18 be moved vertically to the extent that it approaches the end of the coal seam, while staying within the coal seam. For instance, as illustrated in FIG. 2, the head 18 may be pivoted to the upward dotted-line position, at which point it cuts coal up to a new bore ceiling B".

While the cutter 18 is in its second position vertically spaced (e.g. distance V in FIG. 2) from its first position, it is moved rearwardly (by the operating carriage at the bore mouth) toward the bore mouth and continuous cutting the coal. It is moved rearwardly the same predetermined distance (e.g.) which it has been sumped into the coal seam.

During the practice of all of the steps, the cut coal is continuously conveyed to the bore mouth. The method is also practiced by successfully continuing the practice of the sumping, pivoting, and rearwardly-moving steps to progressively move the cutter inwardly into the coal seam, and although the bore may have a varying height along the length thereof due to different thickness of the coal seam (as sensed by the member 45), it will have a height somewhere between the ceiling levels B', and B".

It will thus be seen that according to the present invention an effective method and apparatus for the mining of coal or the like in horizontal seams has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A mining machine for forming, and for use in, elongated generally horizontal bores in coal seams and the like, comprising:

a non-rotatable body member, with stabilizing means for insuring non-rotative movement of said body member in a bore;

a single cutting head mounted in front of said non-rotatable body member, and rotatable about a first axis;

means for rotating said cutting head about said first axis to effect cutting of coal or the like;

conveying means mounted behind said cutting head in operative association with said body member for conveying material cut by said cutting head away from the cutting site in substantially the dimension of elongation of said bore; said conveying means comprising an auger section operatively attached to each of said powered shafts; and scoop means positioned posteriorly of said auger sections and having a bottom portion substantially abutting the bore floor and then extending posteriorly therefrom at a positive angle, said scoop means operatively connected to said side wall supports;

means for pivoting said cutting head first axis about a generally horizontal second axis generally perpendicular to said bore dimension of elongation so that said first axis is movable from a first cutting position of said cutting head, substantially in line with said conveying means, to other cutting positions vertically displaced from said first cutting position;

means for sumping said body member and cutting head;

said non-rotatable body member comprising a pair of side wall supports;

said pivoting means including portions of each of said side wall supports which define pivot means, said pivot means defining said second axis, said second axis being parallel to said cutting head axis of rotation;

said means for pivoting said cutting head further comprising: a pair of support arms operatively connecting said cutting head and said pivot means, said support arms each extending generally parallel to said bore dimension of elongation when said cutting head is in said first position; and power means operatively connected to said arms and said side walls for effecting pivotal movement of said arms about said second axis; and said means for rotating said cutting head comprising a pair of powered shafts operatively connected to said side wall supports for rotation with respect to said body member; a pair of cutting chains; a plurality of sprockets associated with said pair of cutting chains; means for interconnecting a sprocket associated with each cutting chain to a said powered shaft to thereby drive said cutting chain, and said cutting head; one of said cutting chains being mounted in operative association with each of said arms, on the opposite side of said arm as said cutting head; and said powered shafts elongated in the dimension of elongation of said bore and also operatively attached to said conveying means for powering of a part thereof.

2. A machine as recited in claim 1 wherein said power means comprise a pair of hydraulic cylinder assemblies, each having the piston portion thereof connected to one of said arms or one of said side walls, and each having a cylinder portion thereof connected to the other of said one of said arms and one of said side walls.

3. A machine as recited in claim 1 wherein said conveying means further comprises a conveyor belt disposed posteriorly of said scoop means and extending to the bore mouth, said scoop means funnelling toward said conveyor belt, and a top, transporting surface of said conveyor belt disposed adjacent the termination of said scoop means bottom portion.

4. A machine as recited in claim 3 wherein said conveyor belt is operatively associated with a belt take-up unit, said conveyor belt comprising an endless belt, and said take-up unit comprising a series of varying diameter rollers about which said belt is laced so that the length of said belt outside the take-up unit may be automatically adjusted.

5. A machine as recited in claim 1 wherein said non-rotatable body member extends sidewardly, perpendicular to the dimension of elongation of the horizontal bore, the same distance as said cutting chains disposed exteriorly of said sprockets, said cutting chains being the side end terminations of said mining machine.

6. A machine as recited in claim 1 wherein two sprockets are associated with each cutting chain, a front sprocket at a leading portion of the machine, and a rear sprocket at a more rearward portion of the machine; and wherein said sprocket associated with each cutting chain that is connected to a powered shaft comprises said rear sprocket associated with said cutting chain.

* * * * *